US010029344B2

(12) United States Patent
Kamata

(10) Patent No.: US 10,029,344 B2
(45) Date of Patent: Jul. 24, 2018

(54) POLISHING APPARATUS AND POLISHING METHOD

(71) Applicant: EBARA CORPORATION, Tokyo (JP)

(72) Inventor: Shuichi Kamata, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 22 days.

(21) Appl. No.: 15/446,628

(22) Filed: Mar. 1, 2017

(65) Prior Publication Data

US 2017/0266778 A1 Sep. 21, 2017

(30) Foreign Application Priority Data

Mar. 18, 2016 (JP) ..... 2016-055878

(51) Int. Cl.

*B24B 37/005* (2012.01)
*B24B 37/30* (2012.01)
*B24B 49/08* (2006.01)
*B24B 37/20* (2012.01)

(52) U.S. Cl.

CPC ..... *B24B 37/005* (2013.01); *B24B 37/0053* (2013.01); *B24B 37/20* (2013.01); *B24B 37/30* (2013.01); *B24B 49/08* (2013.01)

(58) Field of Classification Search

CPC ... B24B 37/005; B24B 37/0053; B24B 37/30; B24B 37/345; B24B 49/00; B24B 49/08
USPC ..... 451/5, 8, 41, 339
See application file for complete search history.

(56) References Cited

U.S. PATENT DOCUMENTS 6,361,648 B1 * 3/2002 Tobin ..... B24B 37/345 118/719
7,044,832 B2 * 5/2006 Yilmaz ..... B24B 37/345 451/288
7,445,543 B2 * 11/2008 Torii ..... B24B 37/345 451/289
2002/0094760 A1 * 7/2002 Lim ..... B24B 37/34 451/41
2008/0085658 A1 * 4/2008 Katsuoka ..... B24B 37/04 451/7
2008/0146124 A1 * 6/2008 Morita ..... B23B 31/307 451/289
2011/0076129 A1 * 3/2011 Yang ..... B24B 37/345 414/806
2016/0114456 A1 * 4/2016 Shinozaki ..... B24B 37/20 451/41

FOREIGN PATENT DOCUMENTS

JP 2014-011432 A 1/2014

* cited by examiner

*Primary Examiner* — Eileen Morgan
(74) *Attorney, Agent, or Firm* — Pearne & Gordon LLP

(57) ABSTRACT

A polishing apparatus capable of enabling a user to know a frequency and a trend of a retry operation of retrying a substrate release operation is disclosed. The polishing apparatus includes: a substrate holder configured to press a substrate against a polishing pad; a fluid ejection system configured to eject a fluid into a gap between the substrate and a flexible membrane for releasing the substrate from a substrate holding surface; an operation controller configured to instruct the fluid ejection system to perform a retry operation of ejecting the fluid again in a case where the release of the wafer has failed; and a monitoring device configured to store a historical information of the retry operation.

11 Claims, 5 Drawing Sheets

POLISHING APPARATUS AND POLISHING METHOD

CROSS REFERENCE TO RELATED APPLICATION

This document claims priority to Japanese Patent Application No. 2016-055878 filed Mar. 18, 2016, the entire contents of which are hereby incorporated by reference.

BACKGROUND

With a recent trend toward higher integration and higher density in semiconductor devices, circuit interconnects become finer and finer and the number of levels in multilayer interconnect is increasing. In the fabrication process of the multilayer interconnect with finer circuit, as the number of interconnect levels increases, film coverage of step geometry (or step coverage) is lowered in thin film formation because surface steps grow while following surface irregularities on a lower layer. Therefore, in order to fabricate the multilayer interconnect, it is necessary to improve the step coverage and planarize the surface. It is also necessary to planarize semiconductor device surfaces so that irregularity steps formed thereon fall within a depth of focus in optical lithography. This is because finer optical lithography entails shallower depth of focus.

Accordingly, the planarization of the semiconductor device surfaces is becoming more important in the fabrication process of the semiconductor devices. Chemical mechanical polishing (CMP) is the most important technique in the surface planarization. This chemical mechanical polishing is a process of polishing a wafer by placing the wafer in sliding contact with a polishing surface of a polishing pad while supplying a polishing liquid containing abrasive grains, such as silica ($SiO_2$), onto the polishing surface.

A polishing apparatus for performing CMP has a polishing table that supports the polishing pad having the polishing surface, and a substrate holder for holding the wafer. The substrate holder is also called a top ring or a polishing head. This polishing apparatus polishes the wafer as follows. The top ring holds the wafer and presses it against the polishing surface of the polishing pad at predetermined pressure. The polishing table and the top ring are moved relative to each other to rub the wafer against the polishing surface to thereby polish a surface of the wafer.

When polishing the wafer, if a relative pressing force applied between the wafer and the polishing pad is not uniform over the entirety of the surface of the wafer, insufficient polishing or excessive polishing would occur depending on the pressing force applied to each portion of the wafer. Thus, in order to even the pressing force exerted on the wafer, the top ring has at its lower part a pressure chamber formed by a flexible membrane (or a membrane). This pressure chamber is supplied with gas, such as air, to press the wafer against the polishing surface of the polishing pad through the membrane under the gas pressure.

After polishing of the wafer is terminated, the wafer on the polishing surface is attracted to the top ring via vacuum suction. The top ring is elevated together with the wafer, and is then moved to a position above a transfer stage. The top ring then releases the wafer from the membrane. The release of the wafer is achieved by ejecting a release shower into a gap between the wafer and the membrane while supplying the gas into the pressure chamber.

When the wafer is released from the membrane, the membrane may expand largely due to deterioration of the membrane. If the membrane expands largely, the release shower does not reach a contact portion of the wafer and the membrane. As a result, the wafer may not be released from the membrane.

SUMMARY OF THE INVENTION

An object of the present invention is to provide a polishing apparatus and a polishing method capable of performing a retry operation of retrying a substrate release operation, and enabling a user to know a frequency and a trend of the retry operation.

Embodiments, which will be described below, relate to a polishing apparatus and a polishing method for polishing a substrate, such as a wafer.

In an embodiment, there is provided a polishing apparatus comprising: a polishing table for supporting a polishing pad; a substrate holder having a substrate holding surface and a pressure chamber which are formed by a flexible membrane, the substrate holder being configured to hold a substrate on the substrate holding surface and to press the substrate against the polishing pad via pressure in the pressure chamber; a fluid ejection system configured to eject a fluid into a gap between the substrate and the flexible membrane for releasing the substrate from the substrate holding surface; an operation controller configured to instruct the fluid ejection system to perform a retry operation of ejecting the fluid again in a case where the release of the wafer has failed; and a monitoring device configured to store a historical information of the retry operation.

In an embodiment, the monitoring device includes a display device configured to display the historical information.

In an embodiment, the polishing apparatus further comprising: a transfer stage configured to be able to receive the substrate released from the substrate holding surface; and a substrate detection sensor mounted to the transfer stage.

In an embodiment, the historical information includes the number of times the retry operation has been performed on the substrate.

In an embodiment, the historical information further includes an identification number of the substrate on which the retry operation has been performed and a set time for the ejection of the fluid.

In an embodiment, the monitoring device is configured to store the historical information of the retry operation when the number of times the retry operation has been performed on the substrate is not less than a threshold value.

In an embodiment, there is provided a polishing method comprising: rotating a polishing table supporting a polishing pad; holding a substrate on a substrate holding surface formed by a flexible membrane; pressing the substrate against the polishing pad via pressure in a pressure chamber formed by the flexible membrane to polish the substrate; ejecting a fluid into a gap between the substrate and the flexible membrane for releasing the polished substrate from the substrate holding surface; performing a retry operation of ejecting the fluid again in a case where the release of the wafer has failed; and storing a historical information of the retry operation.

In an embodiment, the polishing method further comprises displaying the historical information.

In an embodiment, the historical information includes the number of times the retry operation has been performed on the substrate.

In an embodiment, the historical information further includes an identification number of the substrate on which the retry operation has been performed and a set time for the ejection of the fluid.

In an embodiment, the polishing method further comprises storing the historical information of the retry operation when the number of times the retry operation has been performed on the substrate is not less than a threshold value.

According to the above-described embodiments, the historical information of the retry operation is stored in the monitoring device. Therefore, a user can know a frequency and a trend of the retry operation from the historical information stored. The user can further judge appropriately a replacement time of the membrane from the frequency and the trend of the retry operation.

DETAILED DESCRIPTION OF EMBODIMENTS

Figure 1:
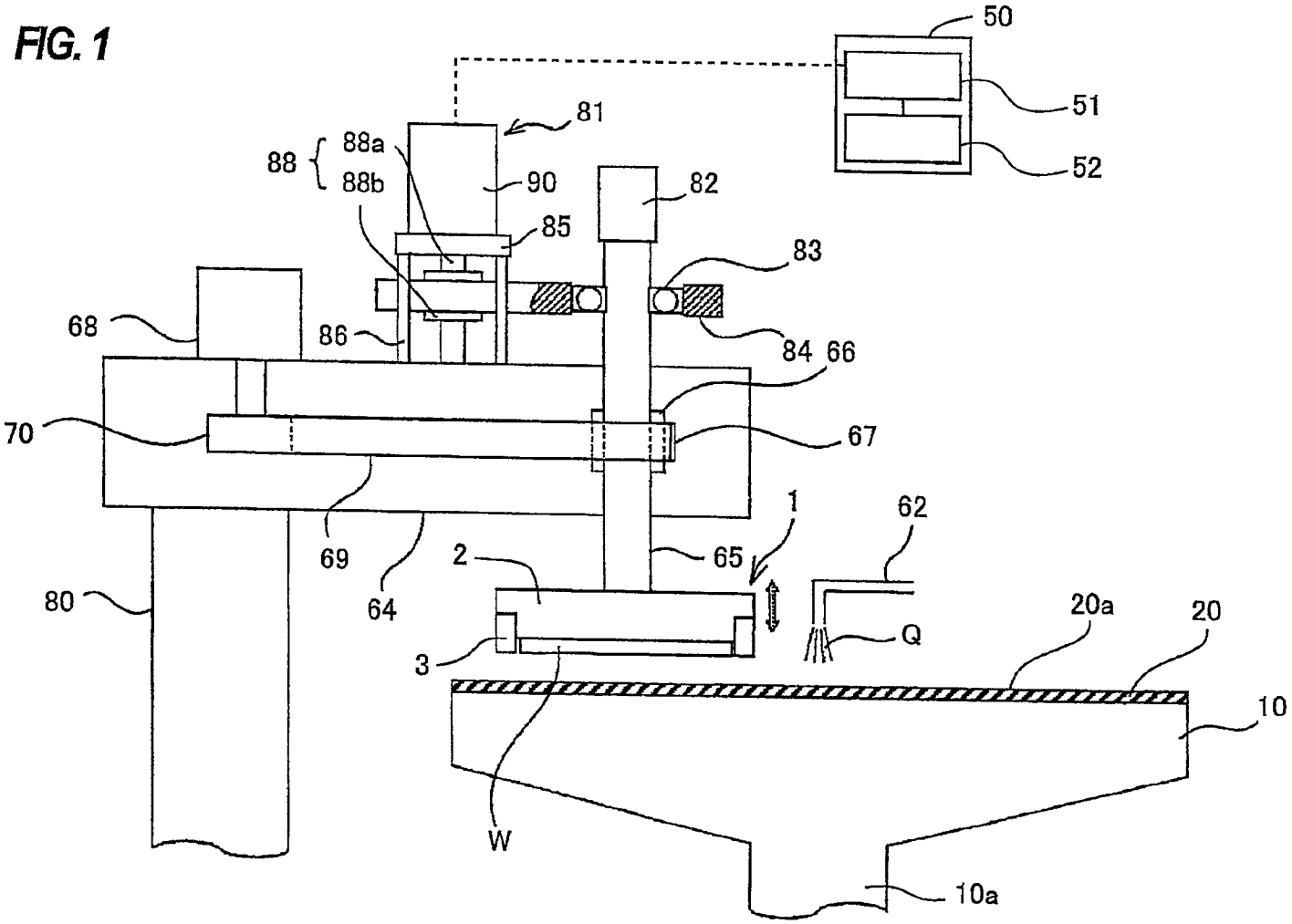
FIG. 1 is a schematic view of an entire structure of a polishing apparatus according to an embodiment.

Embodiments will be described below with reference to the drawings. FIG. 1 is a schematic view showing an entire structure of a polishing apparatus according to an embodiment. As shown in FIG. 1, the polishing apparatus includes a polishing table 10, and a top ring (a substrate holder) 1 for holding a substrate, such as a wafer, as an object to be polished and pressing the substrate against a polishing pad 20 on the polishing table 10.

The polishing table 10 is coupled through a table shaft 10*a* to a motor (not shown) disposed below the polishing table 10. Thus, the polishing table 10 is rotatable about the table shaft 10*a*. The polishing pad 20 is attached to an upper surface of the polishing table 10. An upper surface of the polishing pad 20 serves as a polishing surface 20*a* for polishing a wafer W. A polishing-liquid supply nozzle 62 is provided above the polishing table 10 to supply a polishing liquid Q onto the polishing pad 20 on the polishing table 10.

The top ring 1 includes a top ring body 2 for pressing the wafer W against the polishing surface 20*a*, and a retaining ring 3 for retaining the wafer W so as to prevent the wafer W from being ejected from the top ring 1.

The top ring 1 is connected to a top ring shaft 65, which is vertically movable relative to a top ring head 64 by a vertically moving mechanism 81. The vertical movement of the top ring shaft 65 enables the entirety of the top ring 1 to move upward and downward and enables positioning of the top ring 1 with respect to the top ring head 64. A rotary joint 82 is mounted to the upper end of the top ring shaft 65.

The vertically moving mechanism 81 for vertically moving the top ring shaft 65 and the top ring 1 includes a bridge 84 rotatably supporting the top ring shaft 65 through a bearing 83, a ball screw 88 mounted to the bridge 84, a support pedestal 85 supported by support posts 86, and a servomotor 90 mounted to the support pedestal 85. The support pedestal 85, which supports the servomotor 90, is fixedly mounted to the top ring head 64 through the support posts 86.

The ball screw 88 includes a screw shaft 88*a* coupled to the servomotor 90 and a nut 88*b* that engages with the screw shaft 88*a*. The top ring shaft 65 is vertically movable together with the bridge 84. When the servomotor 90 is set in motion, the bridge 84 moves vertically through the ball screw 88, so that the top ring shaft 65 and the top ring 1 move vertically.

The top ring shaft 65 is coupled to a rotary sleeve 66 by a key (not shown). A timing pulley 67 is secured to a circumferential surface of the rotary sleeve 66. A top ring motor 68 is fixed to the top ring head 64. The timing pulley 67 is operatively coupled to a timing pulley 70, mounted to the top ring motor 68, through a timing belt 69. When the top ring motor 68 is set in motion, the rotary sleeve 66 and the top ring shaft 65 are rotated together with each other through the timing pulley 70, the timing belt 69, and the timing pulley 67, thus rotating the top ring 1. The top ring head 64 is supported by a top ring head shaft 80, which is rotatably supported by a frame (not shown). The polishing apparatus further includes an operation controller 51 for controlling devices including the top ring motor 68 and the servomotor 90.

The top ring 1 is configured to be able to hold the wafer W on its lower surface. The top ring head 64 is configured to be able to pivot on the top ring head shaft 80. Thus, the top ring 1, which holds the wafer W on its lower surface, is moved between a position at which the top ring 1 receives the wafer W and a position above the polishing table 10 by a pivotal movement of the top ring head 64. Polishing of the wafer W is performed as follows. While the top ring 1 and the polishing table 10 are rotated individually, the polishing liquid Q is supplied onto the polishing pad 20 from the polishing-liquid supply nozzle 62 provided above the polishing table 10. In this state, the top ring 1 is lowered and then presses the wafer W against the polishing surface 20*a* of the polishing pad 20. The wafer W is placed in sliding contact with the polishing surface 20*a* of the polishing pad 20, so that a surface of the wafer W is polished.

Figure 2:
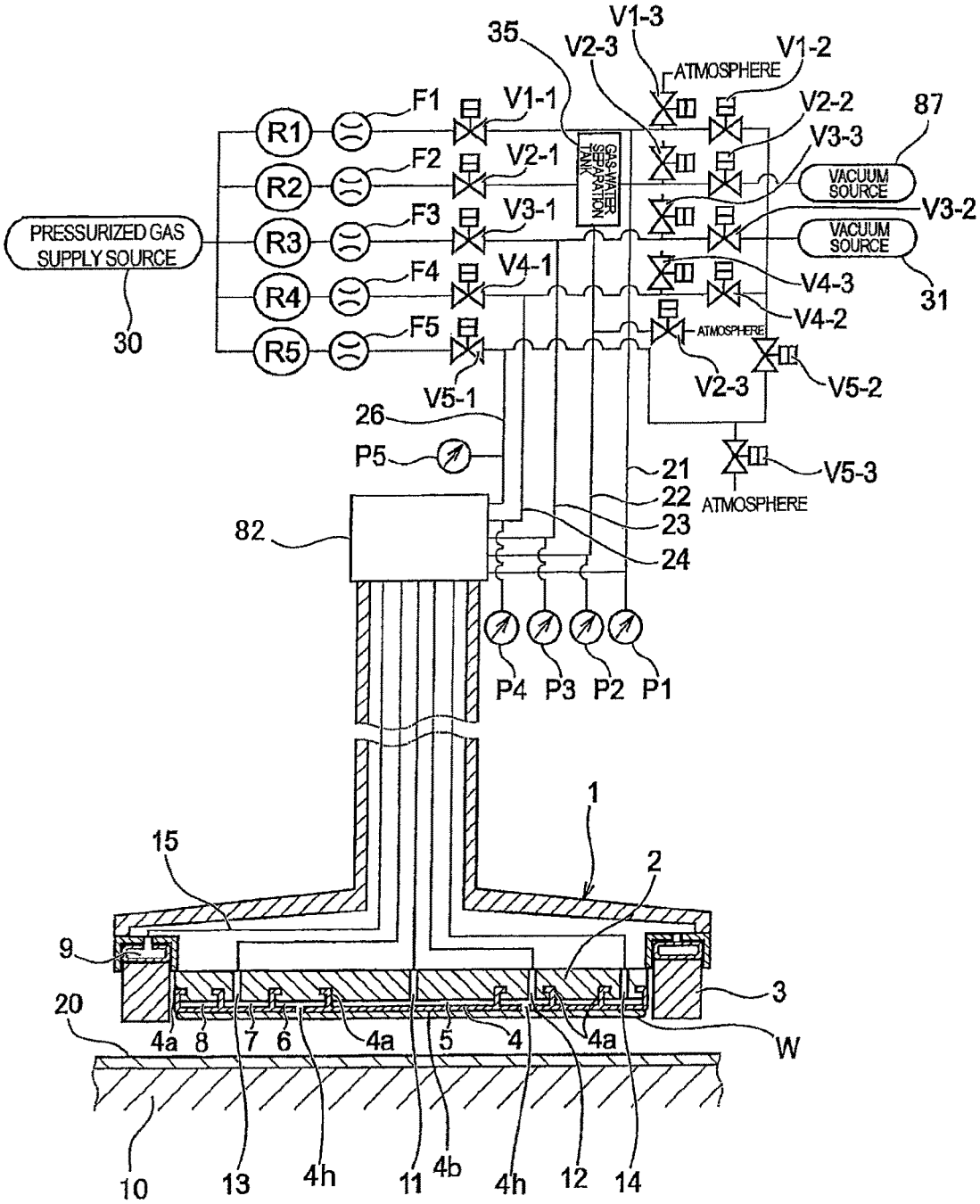
FIG. 2 is a schematic cross-sectional view showing a top ring for holding a wafer as an object to be polished and pressing the wafer against a polishing pad on a polishing table.

Next, the top ring of the polishing apparatus will be described. FIG. 2 is a schematic cross-sectional view showing the top ring 1 for holding the wafer W as an object to be polished and pressing the wafer W against the polishing pad 20 on the polishing table 10. FIG. 2 shows only main structural elements constituting the top ring 1.

As shown in FIG. 2, the top ring 1 includes a membrane (flexible membrane) 4 for pressing the wafer W against the polishing pad 20, the top ring body 2 (which is also referred to as a carrier) holding the membrane 4, and the retaining ring 3 for directly pressing the polishing pad 20. The top ring body 2 is in the form of a circular plate, and the retaining ring 3 is attached to a peripheral portion of the top ring body 2. The top ring body 2 is made of resin, such as engineering plastic (e.g., PEEK). The membrane 4, which is brought into contact with a back surface of the wafer W, is attached to a lower surface of the top ring body 2. The membrane 4 is made of a highly strong and durable rubber material, such as ethylene propylene rubber (EPDM), polyurethane rubber, silicone rubber, or the like.

The membrane 4 has a plurality of concentric partition walls 4*a*, which form multiple pressure chambers: a circular central chamber 5; an annular ripple chamber 6; an annular outer chamber 7; and an annular edge chamber 8. These pressure chambers are located between the upper surface of the membrane 4 and the lower surface of the top ring body 2. The central chamber 5 is defined at the central portion of the top ring body 2, and the ripple chamber 6, the outer chamber 7, and the edge chamber 8 are concentrically defined in this order from the central portion to the peripheral portion of the top ring body 2.

The wafer W is held on a substrate holding surface 4*b* which is constituted by the membrane 4. The membrane 4 has holes 4*h* for wafer suction located at positions corresponding to the position of the ripple chamber 6. While the holes 4*h* are located in the corresponding position of the ripple chamber 6 in this embodiment, the holes 4*h* may be located at positions of other pressure chamber. A passage 11 communicating with the central chamber 5, a passage 12 communicating with the ripple chamber 6, a passage 13 communicating with the outer chamber 7, and a passage 14 communicating with the edge chamber 8 are formed in the top ring body 2. The passage 11, the passage 13, and the passage 14 are connected via the rotary joint 82 to passages 21, 23, and 24, respectively. These passages 21, 23, and 24 are coupled to a pressurized-gas supply source 30 via respective valves V1-1, V3-1, and V4-1 and respective pressure regulators R1, R3, and R4. The passages 21, 23, and 24 are coupled to a vacuum source 31 through valves V1-2, V3-2, and V4-2 respectively, and further communicate with the atmosphere through valves V1-3, V3-3, and V4-3 respectively.

The passage 12, communicating with the ripple chamber 6, is coupled to the passage 22 via the rotary joint 82. The passage 22 is coupled to the pressurized-gas supply source 30 via a gas-water separation tank 35, a valve V2-1, and a pressure regulator R2. Further, the passage 22 is coupled to a vacuum source 87 via the gas-water separation tank 35 and a valve V2-2, and further communicates with the atmosphere via a valve V2-3.

An annular retaining-ring pressure chamber 9, which is formed by a flexible membrane, is provided right above the retaining ring 3. This retaining-ring pressure chamber 9 is coupled to a passage 26 via a passage 15 formed in the top ring body 2 and via the rotary joint 82. The passage 26 is coupled to the pressurized-gas supply source 30 via a valve V5-1 and a pressure regulator R5. Further, the passage 26 is coupled to the vacuum source 31 via a valve V5-2, and communicates with the atmosphere through a valve V5-3. The pressure regulators R1, R2, R3, R4, and R5 have a pressure regulating function to regulate pressures of the gas (e.g., air or nitrogen) supplied from the pressurized-gas supply source 30 to the central chamber 5, the ripple chamber 6, the outer chamber 7, the edge chamber 8, and the retaining-ring pressure chamber 9, respectively. The pressure regulators R1, R2, R3, R4, and R5 and the valves V1-1 to V1-3, V2-1 to V2-3, V3-1 to V3-3, V4-1 to V4-3, and V5-1 to V5-3 are coupled to the operation controller 51 (see FIG. 1), so that operations of these pressure regulators and these valves are controlled by the operation controller 51. Further, pressure sensors P1, P2, P3, P4, and P5 and flow rate sensors F1, F2, F3, F4, and F5 are attached to the passages 21, 22, 23, 24, and 26, respectively.

The wafer W is pressed against the polishing pad 20 by the pressure developed in the pressure chambers 5, 6, 7, 8 which are formed by the membrane 4, whereby the surface of the wafer W is polished. The pressures in the multiple pressure chambers, i.e., the central chamber 5, the ripple chamber 6, the outer chamber 7, the edge chamber 8, and the retaining-ring pressure chamber 9, are measured by the presser sensors P1, P2, P3, P4, and P5, respectively. Flow rates of the pressurized gas supplied to the central chamber 5, the ripple chamber 6, the outer chamber 7, the edge chamber 8, and the retaining-ring pressure chamber 9 are measured by the flow rate sensors F1, F2, F3, F4, and F5, respectively.

In the top ring 1 shown in FIG. 2, the central chamber 5 is located at the central portion of the top ring body 2, and the ripple chamber 6, the outer chamber 7, and the edge chamber 8 are concentrically located in this order from the central portion to the peripheral portion of the top ring body 2, as described above. The pressures of the gas supplied to the central chamber 5, the ripple chamber 6, the outer chamber 7, the edge chamber 8, and the retaining-ring pressure chamber 9 can be independently controlled by the pressurized-gas supply source 30 and the pressure regulators R1, R2, R3, R4, and R5. With this structure, forces of pressing the wafer W against the polishing pad 20 can be adjusted at respective local areas of the wafer, and a force of pressing the retaining ring 3 against the polishing pad 20 can be adjusted.

Next, a sequence of polishing process of the polishing apparatus shown in FIGS. 1 and 2 will be described.

The top ring 1 receives the wafer W at a substrate transfer position and holds the wafer W thereon via the vacuum suction. Holding of the wafer W under the vacuum suction is achieved by producing a vacuum in the holes 4*h* that are in fluid communication with the vacuum source 87. The top ring 1 which holds the wafer W is lowered to a preset polishing position. At this preset polishing position, the retaining ring 3 is brought into contact with the polishing surface 20*a* of the polishing pad 20, while a small gap (e.g., about 1 mm) is formed between the lower surface (a surface to be polished) of the wafer W and the polishing surface 20*a* of the polishing pad 20, because the wafer W is held by the top ring 1 before the wafer W is polished. At this time, the polishing table 10 and the top ring 1 are being rotated about their own axes. In this state, the membrane 4, which is provided at the back side of the wafer W, is inflated to bring the lower surface of the wafer W into contact with the polishing surface 20*a* of the polishing pad 20. The polishing pad 20 and the wafer W are moved relative to each other, thereby polishing the surface of the wafer W.

After the polishing of the wafer is terminated, the wafer W on the polishing pad 20 is held on the substrate holding surface 4*b* of the membrane 4 via the vacuum suction, and is then moved to a position above a transfer stage 92 (which will be described later) by the top ring 1. Thereafter, the wafer W is released from the top ring 1 onto the transfer stage 92.

Figure 3:
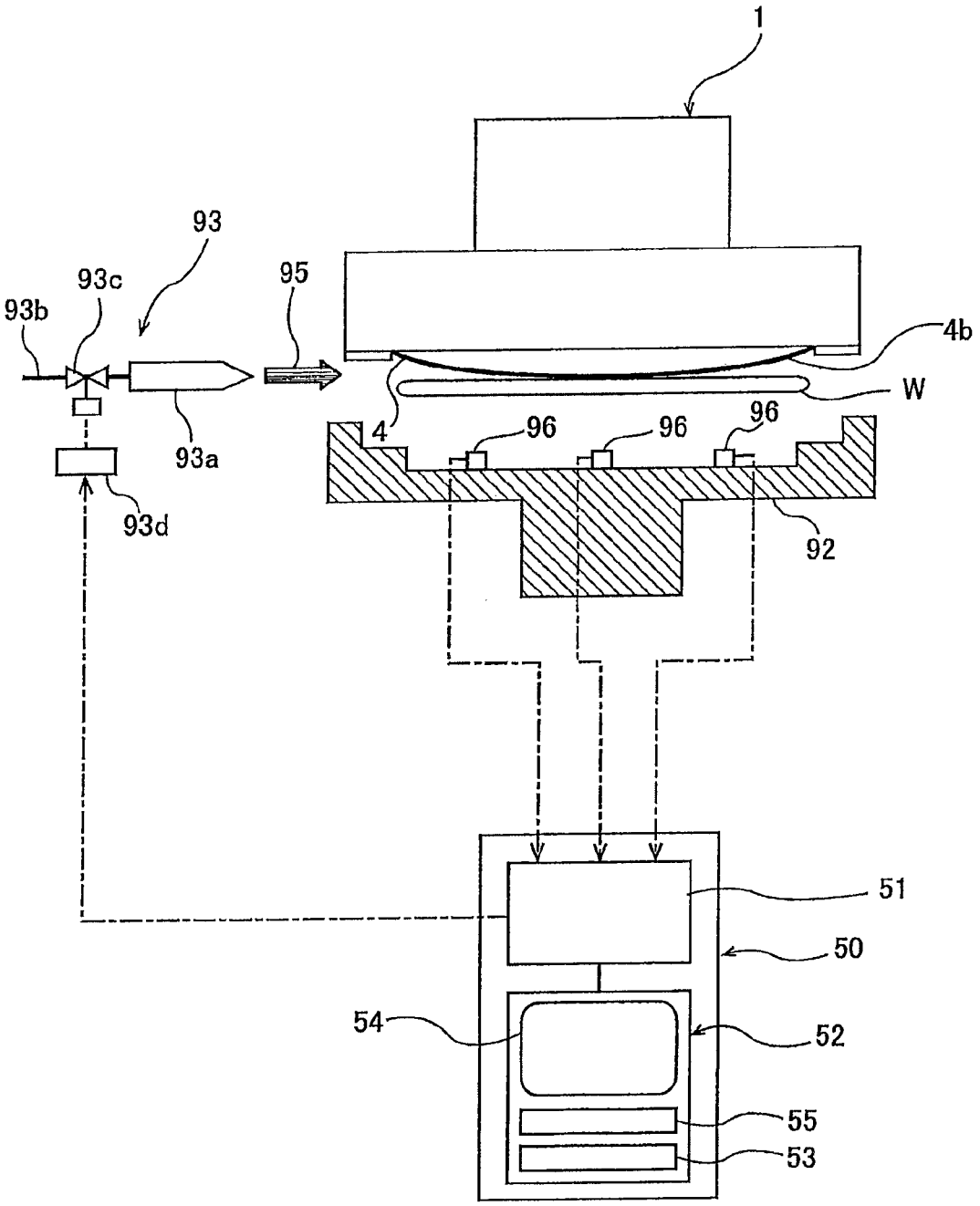
FIG. 3 is a view showing the top ring that has been moved to a position above a transfer stage.

FIG. 3 is a view showing the top ring 1 that has been moved to the position above the transfer stage 92. The transfer stage 92 is disposed adjacent to the polishing table 10. When the wafer W is to be released, the gas, such as $N_2$ gas, is supplied into the pressure chambers 5, 6, 7, 8, to inflate the membrane 4. The transfer stage 92 is configured to be able to receive the wafer W that has been released from the top ring 1.

As shown in FIG. 3, the polishing apparatus includes a fluid ejection system 93 for ejecting a fluid 95 into a gap between the wafer W and the membrane 4 in order to separate the wafer W from the substrate holding surface 4*b* of the membrane 4. The fluid ejection system 93 includes a release nozzle 93*a* for ejecting the fluid 95, a fluid supply line 93*b* coupled to the release nozzle 93*a*, a release valve 93*c* attached to the fluid supply line 93*b*, and a valve controller 93*d* for controlling an operation of the release valve 93*c*. A plurality of release nozzles 93*a* may be provided. The fluid 95 may be a mixture of a liquid such as pure water and a fluid such as $N_2$ gas. The jet of the fluid 95 is directed from the release nozzle 93*a* into the gap between the wafer W and the membrane 4 to thereby release the wafer W from the top ring 1.

Wafer detection sensors (or substrate detection sensors) 96 capable of detecting the wafer are mounted to an upper surface of the transfer stage 92. Only one wafer detection sensor may be provided, while a plurality of wafer detection sensors may preferably be provided in order to improve a wafer detection accuracy. In this embodiment, three wafer detection sensors 96 are provided. Various types of sensor can be used as the substrate detection sensor 96. For example, the wafer detection sensor 96 may be a contact-type sensor or a non-contact-type sensor.

A controlling system 50 includes the operation controller 51 for controlling an operation of each device of the polishing apparatus. The operation controller 51 may be a programmable-logic-controller (PLC). The operation controller 51 is coupled to the devices including the top ring motor 68 and the servomotor 90. The operation controller 51 is further coupled to the pressure regulators R1, R2, R3, R4, and R5 and the valves V1-1 to V1-3, V2-1 to V2-3, V3-1 to V3-3, V4-1 to V4-3, and V5-1 to V5-3.

The wafer detection sensors 96 are coupled to the operation controller 51. The operation controller 51 is coupled to the valve controller 93*d* of the fluid ejection system 93, so that the operation of the fluid ejection system 93 is controlled by the operation controller 51.

When the wafer W is released from the top ring 1, the wafer W is received by the transfer stage 92. When the wafer detection sensor 96 detects the wafer W on the transfer stage 92, the wafer detection sensor 96 sends a wafer detection signal to the operation controller 51. The wafer detection signal (or substrate detection signal) is a signal which indicates that the wafer W exists on the transfer stage 92. When the operation controller 51 receives the wafer detection signal, the operation controller 51 moves the transfer stage 92.

As described above, the membrane 4 may expand largely due to deterioration of the membrane 4. As a result, the jet of the fluid 95 may fail to release the wafer W from the membrane 4. Thus, the operation controller 51 is configured to instruct the fluid ejection system 93 to perform a retry operation of ejecting the fluid 95 again if the release of the wafer W has failed.

The controlling system 50 includes a monitoring device 52 for monitoring the retry operation. The monitoring device 52 is coupled to the operation controller 51. The monitoring device 52 may be disposed away from the operation controller 51. For example, the monitoring device 52 may be coupled to the operation controller 51 through a wire communication, a wireless communication, or a network. A general-purpose computer may be used as the monitoring device 52.

The monitoring device 52 includes an input device 53 for inputting various types of set values for the operation of the devices of the polishing apparatus, in particular the operation of the fluid ejection system 93. The monitoring device 52 further includes a storage device 55 for storing therein a historical information of the retry operation of the fluid ejection system 93, and a display device 54 for displaying the historical information that has been stored in the storage device 55. The above-described various types of set values include a set time for the fluid ejection of the fluid ejection system 93 and an upper limit value of the number of times of the retry operation. The set values that have been inputted to the monitoring device 52 through the input device 53 are sent to the operation controller 51. The operation controller 51 operates the fluid ejection system 93 according to the set values.

Figure 4:
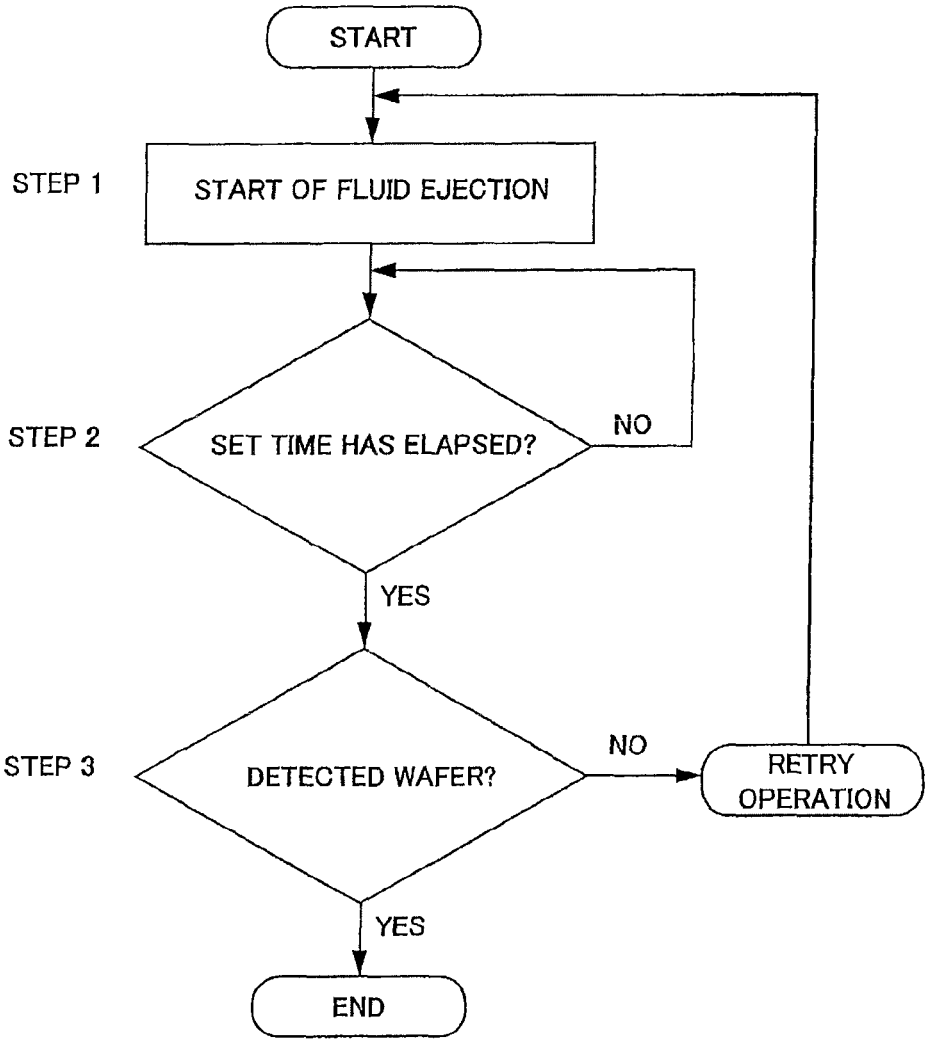
FIG. 4 is a flow chart illustrating a wafer release operation.

FIG. 4 is a flow chart illustrating the wafer release operation. The fluid ejection system 93 starts the ejection of the fluid 95 into the gap between the wafer W and the membrane 4 when the membrane 4 is inflated (step 1). The fluid ejection of the fluid ejection system 93 is performed for the set time (step 2). The set time is determined arbitrarily by a user, and is inputted to the monitoring device 52 through the input device 53. For example, the set time for the fluid ejection is in a range of 5 seconds to 10 seconds.

After the set time has elapsed, the operation controller 51 determines whether the wafer detection sensor 96 has detected the wafer W (step 3). When the wafer detection sensor 96 detects the wafer W, the wafer detection signal is sent to the operation controller 51. Therefore, the fact that the operation controller 51 has received the wafer detection signal means that the release of the wafer W is completed. If the release of the wafer W has failed, i.e., if the wafer detection sensor 96 has not detected the wafer W while the fluid ejection has been performed for the set time, the operation controller 51 instructs the fluid ejection system 93 to perform the retry operation of ejecting the fluid 95 again.

In a case where the wafer W is not released even after the retry operation is performed, the retry operation is repeated. The operation controller 51 is configured to count the number of times the retry operation is performed on the wafer W. The upper limit value of the number of times of the retry operation is inputted into the monitoring device 52 through the input device 53. This upper limit value is determined arbitrarily by a user. The upper limit value may be 1. In this case, the retry operation is performed only one time. If the number of times of the retry operation has reached the upper limit value while the wafer detection sensor 96 has not detected the wafer W, the operation controller 51 may emit an alarm signal.

Figure 5:
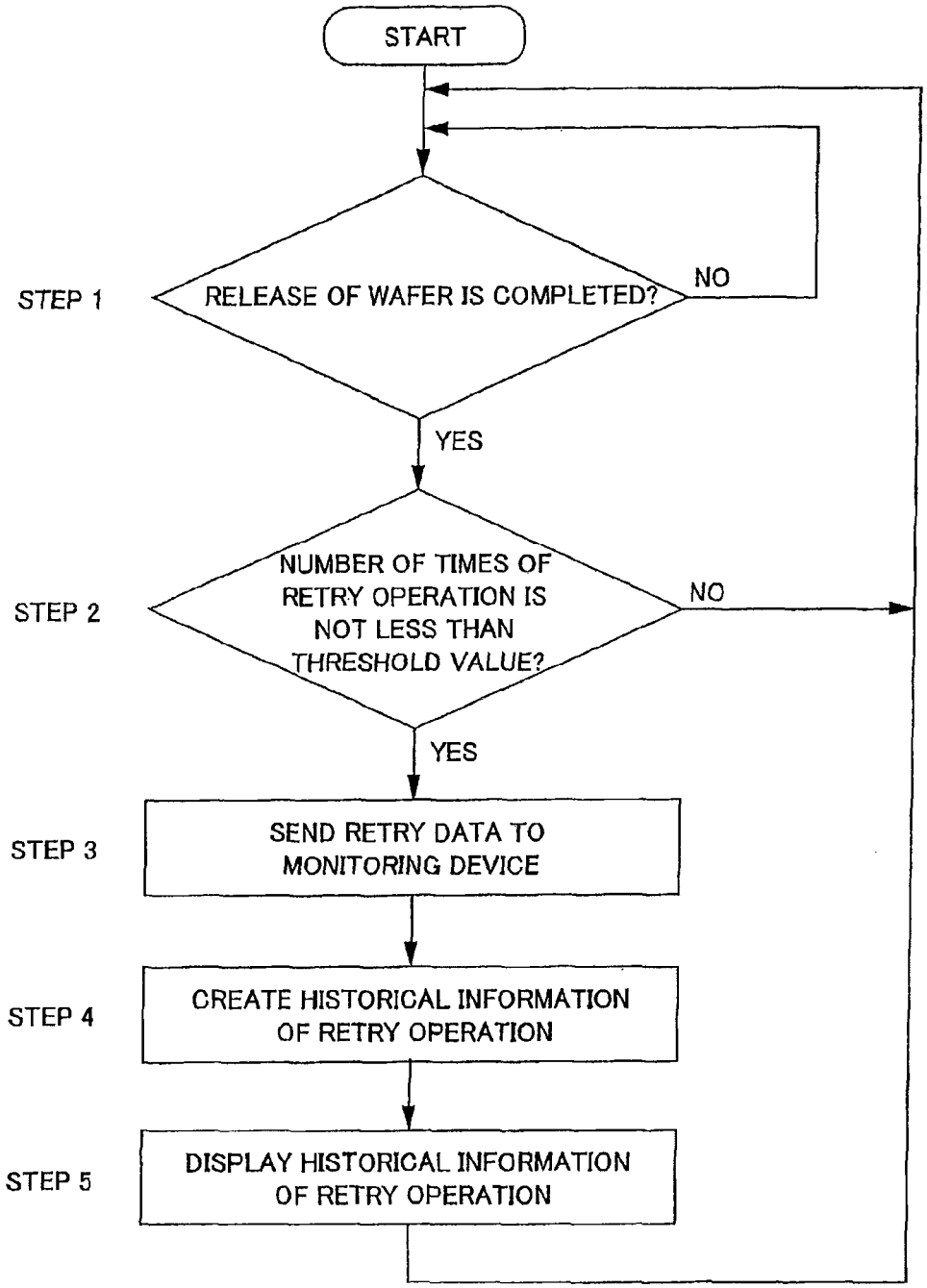
FIG. 5 is a flow chart for monitoring a retry operation.

FIG. 5 is a flow chart for monitoring the retry operation. After the release of the wafer W is completed (step 1), the operation controller 51 determines whether the number of times of the retry operation is not less than a threshold value. The threshold value is determined arbitrarily by a user. In one embodiment, the threshold value is 1. The threshold value is inputted into the monitoring device 52 through the input device 53 and is sent to the operation controller 51. If the number of times of the retry operation is not less than the threshold value, the operation controller 51 sends retry data representing the retry operation to the monitoring device 52 (step 3). The retry data include at least an identification number of the wafer W, the number of times the retry operation has been performed on that wafer W, and the set time for the fluid ejection. The identification number of the wafer W is the number assigned to that wafer W for identifying the wafer W.

After the monitoring device 52 has received the retry data, the monitoring device 52 creates the historical information of the retry operation (step 4), and then the storage device 55 stores the historical information of the retry operation therein. The historical information of the retry operation includes at least the number of times the retry operation has been performed on the wafer W. The historical information of the retry operation may further include the identification number of the wafer W and the set time for the fluid ejection. The display device 54 of the monitoring device 52 displays the historical information of the retry operation (step 5).

In a case where the number of times of the retry operation is less than the threshold value in the step 2, the operation controller 51 does not send the retry data to the monitoring device 52. In this case, the historical information of the retry operation is not created and is not stored in the storage device 55.

An example of the historical information of the retry operation to be displayed on the display device 54 is as follows.

"C1W01; Retry=1; Release time=10.0 [s]"

where, "C1W01" indicates the identification number of the wafer W, "Retry=1" indicates that the number of times the retry operation has been performed by the fluid ejection system 93 is 1, and "Release time=10.0 [s]" indicates that the set time for the fluid ejection is 10.0 seconds.

Since the historical information of the retry operation is stored in the storage device 55 of the monitoring device 52, the number of times of the retry operation and the fluid ejection time can be easily counted. The user can know a frequency and a trend of the retry operation based on the historical information of the retry operation stored in the storage device 55. Therefore, the user can appropriately judge a replacement time of the membrane 4. The operation controller 51 may automatically emit a failure alarm in a case where the number of times of the retry operation is not less than a threshold value.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus comprising:

a polishing table for supporting a polishing pad;

a substrate holder having a substrate holding surface and a pressure chamber which are formed by a flexible membrane, the substrate holder being configured to hold a substrate on the substrate holding surface and to press the substrate against the polishing pad via pressure in the pressure chamber;

a fluid ejection system configured to eject a fluid into a gap between the substrate and the flexible membrane for releasing the substrate from the substrate holding surface;

an operation controller configured to instruct the fluid ejection system to perform a retry operation of ejecting the fluid again in a case where the release of the wafer has failed; and a monitoring device configured to store a historical information of the retry operation.

2. The polishing apparatus according to claim 1, wherein the monitoring device includes a display device configured to display the historical information.

3. The polishing apparatus according to claim 1, further comprising:

a transfer stage configured to be able to receive the substrate released from the substrate holding surface; and a substrate detection sensor mounted to the transfer stage.

4. The polishing apparatus according to claim 1, wherein the historical information includes the number of times the retry operation has been performed on the substrate.

5. The polishing apparatus according to claim 4, wherein the historical information further includes an identification number of the substrate on which the retry operation has been performed and a set time for the ejection of the fluid.

6. The polishing apparatus according to claim 1, wherein the monitoring device is configured to store the historical information of the retry operation when the number of times the retry operation has been performed on the substrate is not less than a threshold value.

7. A polishing method comprising:

rotating a polishing table supporting a polishing pad;

holding a substrate on a substrate holding surface formed by a flexible membrane;

pressing the substrate against the polishing pad via pressure in a pressure chamber formed by the flexible membrane to polish the substrate;

ejecting a fluid into a gap between the substrate and the flexible membrane for releasing the polished substrate from the substrate holding surface;

performing a retry operation of ejecting the fluid again in a case where the release of the wafer has failed; and storing a historical information of the retry operation.

8. The polishing method according to claim 7, further comprising:

displaying the historical information.

9. The polishing method according to claim 7, wherein the historical information includes the number of times the retry operation has been performed on the substrate.

10. The polishing method according to claim 9, wherein the historical information further includes an identification number of the substrate on which the retry operation has been performed and a set time for the ejection of the fluid.

11. The polishing method according to claim 7, further comprising:

storing the historical information of the retry operation when the number of times the retry operation has been performed on the substrate is not less than a threshold value.

* * * * *